US009468933B2

(12) United States Patent
Schwelling

(10) Patent No.: US 9,468,933 B2
(45) Date of Patent: Oct. 18, 2016

(54) SHREDDER WITH TURBO FUNCTION

(71) Applicant: Hermann Schwelling, Salem (DE)

(72) Inventor: Hermann Schwelling, Salem (DE)

( * ) Notice: Subject to any disclaimer, the term of this patent is extended or adjusted under 35 U.S.C. 154(b) by 599 days.

(21) Appl. No.: 13/749,352

(22) Filed: Jan. 24, 2013

(65) Prior Publication Data

US 2013/0200184 A1 Aug. 8, 2013

(30) Foreign Application Priority Data

Jan. 27, 2012 (DE) ..... 10 2012 100 681

(51) Int. Cl.
*B02C 25/00* (2006.01)
*B02C 18/00* (2006.01)
*B02C 18/16* (2006.01)

(52) U.S. Cl.
CPC ..... *B02C 25/00* (2013.01); *B02C 18/0007* (2013.01); *B02C 2018/0038* (2013.01); *B02C 2018/164* (2013.01)

(58) Field of Classification Search
CPC ..... B02C 25/00; B02C 18/0007; B02C 2018/0038; B02C 2018/164
USPC ..... 241/36, 100, 236, 295
See application file for complete search history.

(56) References Cited

U.S. PATENT DOCUMENTS 4,562,971 A 1/1986 Schwelling
4,773,603 A 9/1988 Schwelling
4,809,916 A 3/1989 Schwelling
4,830,295 A 5/1989 Schwelling
5,014,920 A 5/1991 Schwelling
5,044,920 A 9/1991 Gerlach
5,261,614 A 11/1993 Schwelling
5,362,000 A 11/1994 Schwelling
5,375,781 A 12/1994 Schwelling
5,375,782 A 12/1994 Schwelling
5,429,313 A 7/1995 Schwelling
5,474,243 A 12/1995 Schwelling
5,893,524 A 4/1999 Schwelling
5,897,065 A 4/1999 Schwelling
5,934,584 A 8/1999 Schwelling (Continued)

FOREIGN PATENT DOCUMENTS

DE 19525027 A1 7/1995
DE 202007004974 U1 9/2007
DE 202007004824 U1 10/2007
DE 202007004828 U1 10/2007
DE 202007004830 U1 10/2007

(Continued)

*Primary Examiner* — Mark Rosenbaum
(74) *Attorney, Agent, or Firm* — Kolisch Hartwell, P.C.

(57) ABSTRACT

A document shredder with a motor, a cutting unit, and a motor control, wherein the motor control may start, stop and reverse the motor. The motor control may limit the maximally allowed load of the motor to a predetermined load limit value. In case the motor reaches the maximally allowed load limit value, the load limit value may be increased for a predetermined time, either manually or automatically. In this way a short overload does not lead to a paper jam and the shredder does not have to be reversed, which may cause a paper mess in the workplace. The motor may be a direct current motor and/or a series motor, so that the load limit value may be defined by a maximally allowable motor current.

23 Claims, 2 Drawing Sheets

(56) References Cited

U.S. PATENT DOCUMENTS

Figure 1:
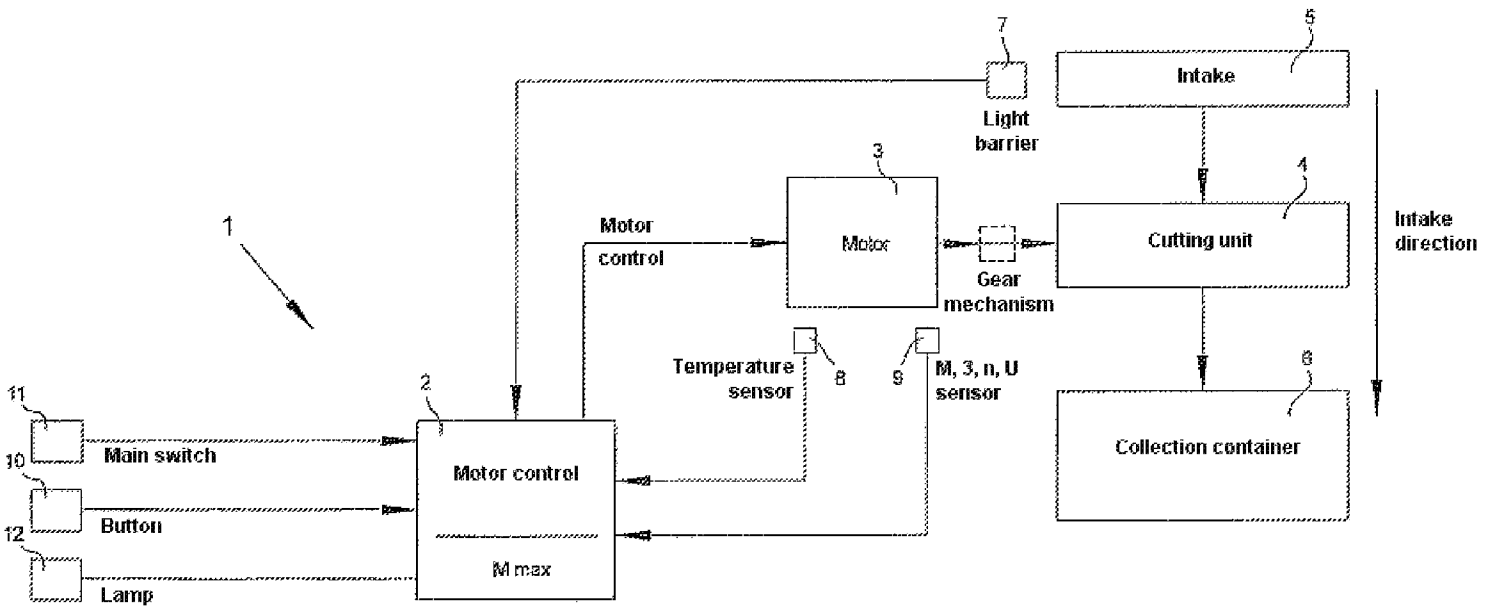

| | | | |
|---|---|---|---|
| 5,969,310 | A | 10/1999 | Schwelling |
| 6,116,528 | A | 9/2000 | Schwelling |
| 6,213,417 | B1 | 4/2001 | Schwelling |
| 6,595,444 | B2 | 7/2003 | Schwelling |
| 7,540,235 | B2 | 6/2009 | Schwelling |
| 7,556,213 | B2 | 7/2009 | Schwelling |
| 7,721,982 | B2 | 5/2010 | Schwelling et al. |
| 2002/0014547 | A1 | 2/2002 | Schwelling |
| 2004/0104289 | A1 | 6/2004 | Schwelling |
| 2006/0288886 | A1 | 12/2006 | Schwelling |
| 2007/0080251 | A1 | 4/2007 | Schwelling |
| 2008/0210794 | A1 | 9/2008 | Schwelling |
| 2010/0001109 | A1 | 1/2010 | Schwelling |
| 2010/0050532 | A1 | 3/2010 | Schwelling |
| 2010/0058942 | A1 | 3/2010 | Schwelling |
| 2010/0187341 | A1 | 7/2010 | Schwelling |
| 2011/0266379 | A1* | 11/2011 | Romanovich et al. ..... 241/30 |
| 2012/0001001 | A1 | 1/2012 | Schwelling |

FOREIGN PATENT DOCUMENTS

| | | | |
|---|---|---|---|
| DE | 202007004970 | U1 | 10/2007 |
| DE | 202007004826 | U1 | 12/2007 |
| EP | 0363810 | A2 | 4/1990 |
| EP | 2063994 | A1 | 6/2009 |
| GB | 2215236 | A | 9/1989 |
| WO | 9848937 | A1 | 11/1998 |
| WO | 0162390 | A2 | 8/2001 |
| WO | 03066222 | A1 | 8/2003 |
| WO | 2004096532 | A1 | 11/2004 |
| WO | 2005046876 | A1 | 5/2005 |
| WO | 2008025551 | A1 | 3/2008 |

* cited by examiner

SHREDDER WITH TURBO FUNCTION

I. FIELD OF THE APPLICATION

The invention relates to a document shredder with a turbo function, and also to a method for operating a document shredder of this kind.

II. TECHNICAL BACKGROUND

Document shredders are used to destroy documents (that is to say files) containing confidential information. Documents of this kind are primarily to be understood to be sheets (of paper) but also folders, floppy disks, CDs or other data storage media.

In order to destroy, that is to say shred, the documents, a document shredder has a motor-operated cutting unit which cuts the document, which is to be shredded, into pieces. To this end, the document shredder has a document intake and a container which receives the documents which have been cut into pieces.

One problem with document shredders is that they can be overloaded by documents which are too thick, in particular by too many sheets, being inserted. In order to pre-empt overloading, which is harmful to the document shredder, and to prevent paper becoming jammed or stuck, customary document shredders automatically switch off at a predetermined load limit value, that is to say they switch off the drive of their cutting unit, and possibly initiate a reverse mode by way of which the drive direction of the motor is reversed and by way of which the document which is to be shredded is discharged again.

The prior art also discloses equipping document shredders with a turbo mode in which the torque of the motor which drives the cutting unit is increased.

DE 195 25 027 A1 describes, for example, a document shredder of which the cutting unit is driven by a drive motor which is in the form of a capacitor motor with an operating capacitor. When the drive motor of the cutting unit is overloaded, said drive motor is operated for a short time in the reverse mode and switched off. An auxiliary capacitor which can be connected in parallel to the operating capacitor of the drive motor is then switched on for a short period, preferably for passage of documents, as a result of which the torque of the drive motor can be increased.

One disadvantage of said document shredder is that activation of the turbo mode, that is to say the increase in the torque, necessarily requires that an additional electrical component of the electric motor is connected. Therefore, firstly, it is necessary for this additional component to be present and functional. Secondly, the turbo mode cannot be activated simply by adjusting or setting the operating parameters of the motor. Therefore, the solution is a hardware-based solution with which purely software-based activation is impossible. A further disadvantage is that a capacitor motor, as is known, has a low torque at low rotation speeds, and therefore the increase in the torque by the auxiliary capacitor primarily constitutes compensation of this drop in torque.

III. SUMMARY OF THE INVENTION a) Problem

The object of the present invention is therefore to provide a document shredder with a turbo function, said document shredder representing an alternative solution to the document shredder which is known from said prior art and, in particular, overcoming the disadvantages of said document shredder. A further object of the invention is to provide a corresponding method for operating a document shredder.

b) Achievement of the object

This object is achieved by the features of claims 1 and 11. Advantageous embodiments can be found in the dependent claims.

The invention proposes a document shredder having a cutting unit, a motor for driving the cutting unit, and also a motor control with an overload limit. The overload limit prespecifies a maximum load limit value for the motor.

According to the invention, the motor is in the form of a direct current motor or a series machine. As a result, the particularly advantageous properties of direct current motors, which are likewise present in series machines, can be utilized in the invention. According to the characteristic of direct current motors, the torque increases greatly as the rotation speed falls, that is to say the rotation speed is approximately inversely proportional to the torque. This is particularly true of direct current motors, that is to say motors with permanent magnets stator, or else for series machines of any design, that is to say even for universal motors and/or single-phase series motors which are operated with direct or alternating current.

This means that the torque of the motor increases as the load increases, that is to say due to a thicker document which is to be shredded, since the rotation speed falls due to the higher load.

However, since an excessive torque can lead to damage to or destruction of the gear mechanism, if present, for transmitting the motor force to the cutting unit and to damage to or destruction of the cutting unit itself, and also overheating of the motor can be caused due to the high currents occurring in the rotor of the motor, the invention provides the above-mentioned overload limit which prespecifies a maximum load limit value, that is to say a maximum motor torque which is permitted by the motor control.

However, since this maximum load limit value is only an upper limit which is defined by the motor control, but the motor is able to generate even higher loads, that is to say torques, the invention proposes, in the case of this load limit value being reached, providing for an optional increase in the load limit value, at least for a predetermined time.

This has the advantage that the user, when employing this option of increasing the load limit value, can leave the motor control to continue to operate the motor in the intake, that is to say shredding, direction, but with a higher torque now being permitted by the motor control. Therefore, at least the document which is currently located in the intake can be shredded with an increased torque. In the case of the solution according to the invention, the absolute value of the maximum permissible torque is advantageously increased. This therefore does not involve compensation of a torque which drops at low rotation speeds.

Therefore, a turbo function of the document shredder is activated by increasing the load limit value. In this case, the turbo function is activated solely by corresponding actuation of the motor by the motor control. To be precise, the turbo function is activated by adjusting the actuation of the existing components which are in operation. It can therefore be performed in a purely software-based manner. It is not necessary to connect components which have been inactive up until this point.

According to the invention, a reverse mode, which often leads to mess in the workspace created by scraps (of paper), can be prevented. However, since increasing the load limit value is only one option, it is equally at the discretion of the user as to whether to initiate the reverse mode in order to retrieve the document, which is to be shredded, from the document shredder again.

As an alternative to the manually initiated increase in the load limit value, as described above, the increase can also be made automatically. For example, it is feasible for the motor control to automatically increase the load limit value and operate the motor in the intake direction after an additional action (as described below) has been performed or after a fixed time period, for example of 10 seconds, in which the user has not selected either of the two abovementioned options has elapsed.

As already mentioned, in the case of the load limit value being reached, a further action can also be provided before the load limit value can be increased for the predetermined time. This action serves primarily to indicate that the load limit value has been reached and can therefore also be omitted. This action is preferably an action which is automatically carried out by the motor control and in which the motor is operated temporarily in the reverse mode and then stopped, that is to say switched off. The user can then selectively increase the load limit value and at the same time initiate the intake mode of the motor, with the result that the document is shredded, or said user can initiate the reverse mode of the motor, with the result that the document is discharged from the document shredder.

The maximum load limit value which can be set by the motor control can be defined by different operating parameters of the motor, for example a maximum permissible current (that is to say a current restriction) for operating the motor and/or by a maximum permissible motor torque and/or by a minimum rotation speed of the motor.

In order to establish whether an increase in the load limit value should be made available, the motor control compares the actual values of the motor operating parameters with the setpoint values, and it is therefore established whether the actual load of the motor reaches the maximum load limit value. The motor operating parameters used for this purpose can be the motor current and/or the motor rotation speed and/or the motor torque.

According to the invention, the load limit value is increased only for a predetermined time. This predetermined time is advantageously ended when the document which is to be shredded and requires the increase in the load limit value has been completely shredded. In order to establish this, the document shredder can have a sensor, in particular a light barrier or a rocker, which is arranged at the intake of the document shredder, that is to say in the intake direction, just in front of the cutting unit of the document shredder. When this sensor signals to the motor control that a document is no longer detected, the predetermined time is continued for a fixedly set run-on time and then ended. Since the sensor is located just in front of the cutting unit in the intake direction, the fixedly set run-on time is preferably set such that the document is completely cut into pieces by the cutting unit after the run-on time has elapsed.

Since the document has been completely shredded after the predetermined time has elapsed, the maximum load limit value can now be reset to its initial level again and the motor can also be switched off.

As an alternative or in addition, it is also feasible for the maximum load limit value to be manually reset. This can be done, in particular, by operating a main switch of the document shredder or by disconnecting the power supply to the document shredder. It is possible, in principle, for the maximum load limit value to be reached again after it has already been increased. This is possible, for example, when the document is so thick that a torque which itself would exceed the load limit value when said load limit value is increased is required to destroy said document. In this case, provision may be made for the motor control to switch off the motor and preferably change over to a reverse mode of the motor in order to thereby discharge the document from the document shredder.

Finally, the invention provides a method for operating a document shredder which has the abovementioned features according to the invention.

The invention makes provision for overloading of the document shredder, in particular the motor and/or the gear mechanism and/or the cutting unit of said document shredder, to be identified on the basis of a maximum, predetermined load limit value being reached. In this case, the load limit value is prespecified by a maximum permissible current for operating the motor. In the case of overloading, the motor is operated in a turbo mode, in which the load limit value is increased, for a predetermined time.

c) Exemplary Embodiments

Figure 2:
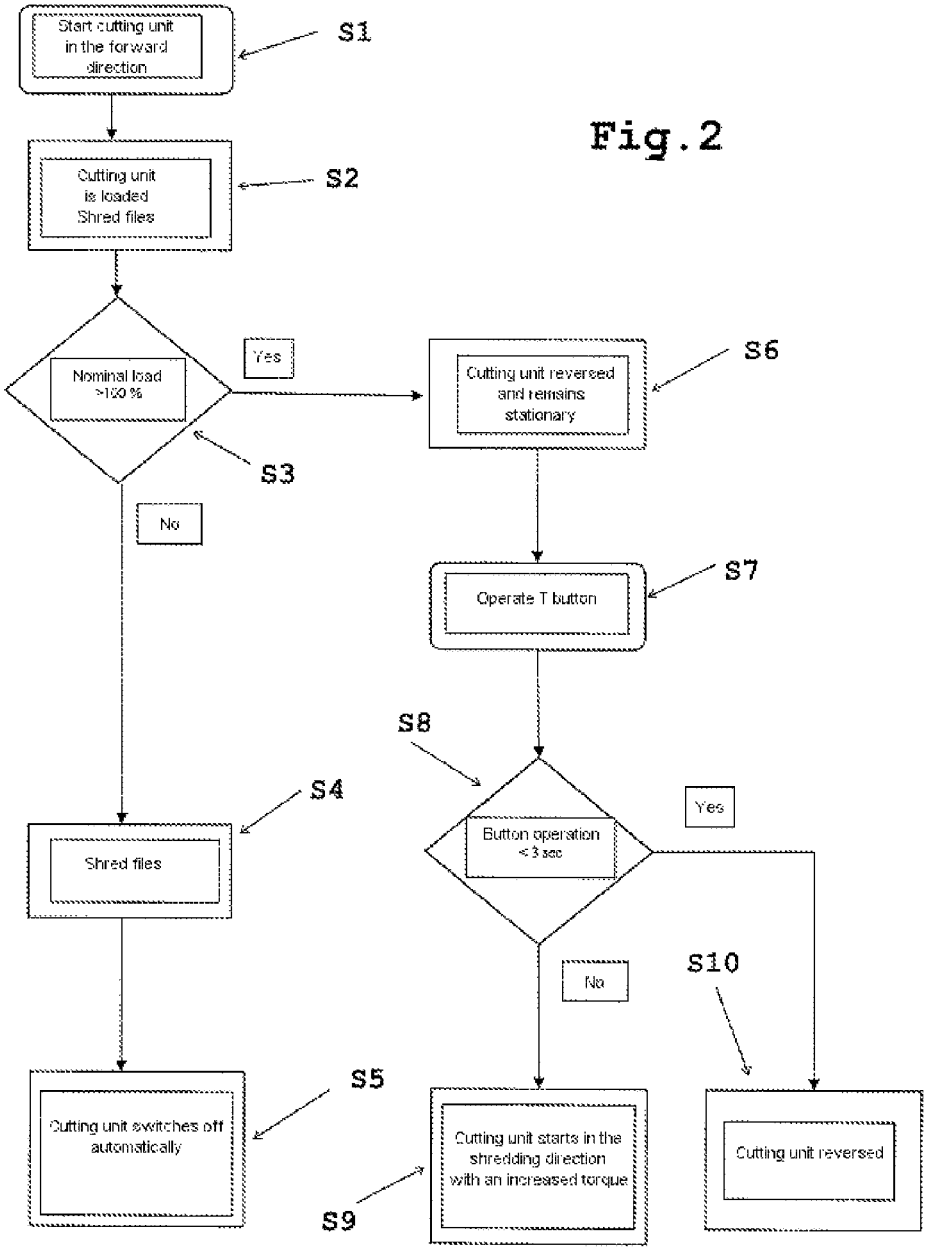

Embodiments according to the invention are described in greater detail by way of example in the text which follows. In the drawings:

FIG. 1 shows a schematic illustration of a document shredder according to the invention, and FIG. 2 shows a flowchart of the method according to the invention.

FIG. 1 shows a block diagram of the document shredder according to the invention. The document shredder 1 has a motor 3 which drives a cutting unit 4 via a gear mechanism. An intake 5 is arranged upstream of the cutting unit 4 in the intake direction, that is to say in the shredding direction of the documents which are to be shredded. A collection container 6, which can be a plastic container for example, is arranged downstream of the cutting unit 4 in the intake direction.

The motor 3 is controlled by a motor control 2. To this end, the motor control 2 firstly controls the motor 3 by setting its operating parameters, for example the motor current and/or the motor voltage. An external energy source—not shown—, for example a rechargeable battery or a mains power connection, supplies electrical energy to the motor control 2 and/or to the motor 3 for this purpose. In addition, a rectifier—likewise not shown—and a circuit for adjusting the current and/or voltage can be provided, these being connected upstream of the motor 3. The motor 3 can accordingly also be controlled by means of the circuit for adjusting the current and/or voltage being actuated by the motor control 2.

The motor 3 may be a direct current motor with permanent magnets in the stator. The motor can also be in the form of any kind of series motor. The motor can therefore be a series machine which is in the form of a direct current motor, or a series machine which is in the form of an alternating current motor. Consequently, the motor can also be a universal motor and/or a single-phase series motor.

The motor 3 may be a permanently excited direct current machine or an electrically excited direct current machine. The use of a compound-wound motor or an externally excited machine is also feasible, as is the use of a bell-armature machine or a brushless direct current machine.

The motor control 2 sets a maximum permissible load limit value $M_{max}$ and operates the motor 3 during the shredding mode for as long as this maximum permissible load limit value $M_{max}$ is not reached. The maximum permissible load limit value $M_{max}$ is preferably defined by a maximum permissible operating current of the motor 3 in this case.

Therefore, the load limit value $M_{max}$ is accordingly a prespecified setpoint value. In order to compare this prespecified setpoint value with actual values of the motor 3, the document shredder 1 has a sensor and/or a measurement circuit 9 which measures one or more operating parameters of the motor 3, for example the torque M, the current I, the voltage U and/or the rotation speed n. The measurement can be performed directly at the motor or else at the circuit upstream of the motor, that is to say at the circuit for adjusting the current and/or voltage. The measurement is returned to the motor control 2. Said motor control 2 then compares the actual value, that is to say the measurement from the sensor 9, with the prespecified setpoint value, that is to say the maximum load limit value $M_{max}$. If the actual value reaches the setpoint value in this case, prespecified actions, as explained in greater detail with reference to FIG. 2, are initiated by the motor control 2.

The prespecified setpoint value, that is to say the maximum load limit value $M_{max}$, may be a factory-preset value or a value which is preset by the user. In this case, it is preferred for the maximum load limit value $M_{max}$ to not correspond to the actual, maximum possible load limit of the motor 3, that is to say to not represent a characteristic variable of the motor 3, but to be below said load limit. The same should apply for the increased, maximum load limit value $M_{max}$ (explained later).

The document shredder 1 also has a temperature sensor 8 which measures the temperature of the motor 3. The measurement result is returned to the motor control 2. If the motor temperature exceeds a prespecified, maximum permissible value, the motor 3 is switched off by the motor control 2.

The document shredder 1 also has a sensor 7 in the region of the intake 5, said sensor establishing the presence of a document, which is to be shredded, in the intake 5. The sensor 7 is, for example, a light barrier or a mechanically operable rocker. The result from the sensor 7 is likewise returned to the motor control 2, wherein the measurement result is preferably a binary value (presence/absence of paper), but a value which reflects the thickness of the document is also feasible.

For the purpose of operating the document shredder, said document shredder has one or more buttons 10, 11. Button 11 is the main switch of the document shredder 1 by means of which the document shredder can be switched on and switched off. In the event of switch-on, the motor control 2 preferably initially activates a stand-by mode of the document shredder, it being possible to activate the shredding mode in said stand-by mode by the presence of a document being sensed by the sensor 7.

The further button 10 serves to initiate the reverse mode of the motor 3 and/or to initiate the turbo mode in which the maximum load limit value $M_{max}$ is increased. However, it is also feasible for the document shredder 1 to have two separate buttons for initiating the two abovementioned functions. Furthermore, it is also possible for the document shredder 1 to have only one button overall, this button serving as a main switch and to initiate the two abovementioned functions. In this case, the length/time period of operation of the button can be used to differentiate between the individual functions.

Finally, the document shredder 1 optionally also has a lamp 12 which indicates whether the maximum permissible load limit value $M_{max}$ has been reached. Instead of the lamp 12 or in addition to it, the document shredder 1 can also have other reproduction capabilities, for example an audio output.

The method according to the invention will now be explained with reference to the flowchart of FIG. 2.

In step S1, the forward operation of the cutting unit 4 in the forward direction is started. To this end, it is initially necessary for the main switch 11 (cf. FIG. 1) to be switched on, with the result that the document shredder 1 enters the stand-by mode. Then, when a document which is to be shredded is held in the intake 5, this is identified by the sensor 7. The forward operation of the cutting unit 4 mentioned in step S1 is then started. The forward direction is understood to mean that the cutting unit 4 draws in the document which is to be shredded and, in the process, cuts it into pieces.

The process of cutting the document into pieces, that is to say the process of shredding the document, causes a load on the cutting unit which is dependent on the thickness and the material of the document, this load being transmitted to the motor 3 via the gear mechanism. This load, which is mentioned in step S2 and requires a torque of the motor 3 which torque corresponds to the load, is measured by the sensor 9, for example by measuring the motor current I. In the case of a direct current motor or a series motor, as the load increases, the torque and the motor current increase greatly, whereas the motor rotation speed falls.

In step S3, a check is then made to determine whether this actual load (that is to say the actual value of the motor 3) is less than or greater than the prespecified load limit value $M_{max}$.

If the measured load is less than the prespecified load limit value $M_{max}$, the document is (that is to say the files are) shredded, as shown in step S4.

As soon as this shredding is complete, the cutting unit 4 is switched off in step S5 by the motor 3 being switched off. In order to establish whether the document has been completely shredded, the sensor 7 checks whether the document is still in the intake 5.

If this is no longer the case, it is to be assumed that the document has been completely cut into pieces by the cutting unit 4 which is arranged downstream of the intake 5 even in a short period of time, that is to say for example within the next 1, 2 or 3 seconds. Therefore, the switch-off operation according to step S5 is performed only after this fixedly set run-on time of, for example, 1, 2 or 3 seconds.

If, however, it is established in step S3 that the measured load reaches the prespecified, maximum load limit value or even exceeds it, the cutting unit 4 and therefore the motor 3 are temporarily operated in the reverse mode for a short time, for example of 0.3, 0.5, 1, 2, 3, 4 or 5 seconds, as a result of which the document which is to be shredded is, at least partially, discharged from the document shredder 1 again. The motor 3 and the cutting unit 4 are then stopped.

However, as an alternative, it is also feasible for the cutting unit 4 and the motor 3 to be immediately stopped, that is to say without the preceding reverse mode, in step S6. It is also feasible for the cutting unit and the motor to be stopped and for this to be followed by a temporary reverse mode which is then stopped again.

In addition, the user is informed of the overloading by the lamp 12 lighting up or flashing in step S3.

Two options are available in step S7, the choice being made either by the user or, as an alternative or in addition, by the document shredder itself, that is to say by the motor control 2 of said document shredder. In this case, the user can make his choice by holding down the button 10 either for less than 3 seconds or longer than 3 seconds according to step S8.

If said user holds said button for less than 3 seconds, that is to say, for example, he presses said button only once briefly, the cutting unit 4 and the motor 3 are therefore reversed according to step S10.

If, however, said user presses the button 10 for longer than 3 seconds, the prespecified, maximum permissible load limit value $M_{max}$ will be increased in step S9. Therefore, the turbo mode, that is to say the turbo function of the document shredder, is activated. At the same time, the motor 3 and the cutting unit 4 are started in the intake direction, that is to say in the shredding direction (which is opposite the reverse direction). Since a higher load on the motor 3 and therefore a higher torque are permitted, the document is then completely shredded. Therefore, step S9 is followed by document shredding as has been described in steps S4 and S5.

However, it is feasible for the required torque for destroying the document to still be above the maximum permissible, increased load limit value $M_{max}$. In this case, step S6 is repeated, wherein the user then has the option of starting the reverse mode by operating the button 10 (irrespective of how long he presses it for), with the result that the user can remove the document from the document shredder or said document automatically falls out of said document shredder. It is also feasible for the reverse mode to be automatically started.

The basic purpose of the reverse mode (that is to say in step S10 and in the above case) is for the document to be released by the document shredder, with the result that the user can either destroy the document in some other way (as may be necessary in the case of a digital data storage medium for example) or, if said document is a stack of paper, divide said stack of paper into individual, thinner portions which are then individually shredded by the document shredder 1.

Provision is not made for a load limit value $M_{max}$ which has already been increased to be increased further, but this option is nevertheless feasible.

After the user has increased the maximum load limit value $M_{max}$ once, that is to say in step S8, his only option if the maximum permissible load limit value $M_{max}$ is reached or exceeded once again is to initiate the reverse mode if this is not automatically initiated.

Instead of step S7 or S8, the activation with an increased load limit value $M_{max}$ according to step S9 can also be performed automatically, for example when the user remains inactive for a certain period of time, for example of 10, 20 or 30 seconds.

After the increase in the maximum load limit value $M_{max}$ in step S9 and complete shredding of the document, as described in steps S4 and S5, both the cutting unit 4 and the motor 3 are switched off (cf. step S5) and the increased load limit value $M_{max}$ is preferably also reset to its original value, as is present in steps S1 to S8 and S10.

The load limit value $M_{max}$ is therefore increased only during a predetermined time. This predetermined time is ended, that is to say the motor control 2 forces said time to end, when the shredding of the document (as described in S5) is concluded. It is also feasible for the increased load limit value $M_{max}$ to be reset when the temperature sensor 8 signals overheating of the motor 3.

Since long-lasting operation of the document shredder with an increased load limit value $M_{max}$ may be undesirable since the gear mechanism, the cutting unit or the motor 3 may possibly be damaged in the process, the predetermined time can have a preset maximum value, of one minute for example, wherein the increased load limit value $M_{max}$ is automatically reset after this time has elapsed.

Finally, it should be possible for the user to manually reset the increased load limit value $M_{max}$, that is to say force the termination of the predetermined time. To this end, said user can firstly switch off the document shredder 1, for example by operating the main switch 11 or by pulling out the mains plug. It is also possible for said user to reset the increased load limit value $M_{max}$ and at the same time stop the shredding process by operating the button 10 for a short or long (that is to say longer than 3 seconds) time, wherein either said user then can have the choice according to step S7 or the reverse mode according to step S10 is automatically started.

LIST OF REFERENCE SYMBOLS

1 Document shredder
2 Motor control
3 Motor
4 Cutting unit
5 Intake
6 Collection container
7 Sensor (light barrier)
8 Temperature sensor
9 Load sensor
10 Buttons
11 Main switch
12 Lamp
$M_{max}$ Maximum load limit value

What is claimed is:

1. A document shredder comprising:
a cutting unit,
a motor for driving the cutting unit during a shredding operation, and
a motor control with an overload limit which prespecifies a maximum load limit value for the motor,
characterized in that
the motor is a direct current motor and/or a series machine, and
the motor control is configured so that if the load limit value is reached during the shredding operation, then the load limit value is increased for a predetermined time.

2. A document shredder according to claim 1, further characterized in that
the load limit value is automatically increased by the motor control or is manually increased.

3. A document shredder according to claim 2, further characterized in that
the motor control defines the load limit value by setting a maximum permissible current for operating the motor and/or by setting a maximum permissible motor torque and/or by setting a minimum rotation speed of the motor.

4. A document shredder according to claim 1, further characterized in that,
if the load limit value is reached, then the motor control initially temporarily operates the motor in the reverse mode and/or switches off the motor, before the load limit value is selectively increased, as a result of which an intake mode of the motor is initiated or the reverse mode of the motor can be initiated.

5. A document shredder according to claim 1, further characterized in that
the motor control defines the load limit value by setting a maximum permissible current for operating the motor and/or by setting a maximum permissible motor torque and/or by setting a minimum rotation speed of the motor.

6. A document shredder according to claim 1 or 5, further characterized in that the document shredder has means for measuring the motor current and/or the motor rotation speed and/or the motor torque, and the measurement is returned to the motor control, wherein the motor control decides whether the load limit value may be increased on the basis of the measurement and the load limit value.

7. A document shredder according to claim 1, further characterized in that the document shredder has a sensor, which identifies whether documents which are to be shredded are located in an intake of the document shredder, and the motor control ends the predetermined time, in the case of no files being identified in the intake.

8. A document shredder according to claim 7, further characterised in that the sensor is a light barrier or a rocker.

9. A document shredder according to claim 7, further characterised in that the motor control ends the predetermined time after a fixedly set run-on-time.

10. A document shredder according to claim 7, further characterized in that the motor control resets the load limit value after the predetermined time.

11. A document shredder according to claim 10, further characterised in that the motor control switches off the motor at the same time at which the motor control resets the load limit value after the predetermined time.

12. A document shredder according to claim 1, further characterized in that the load limit value can be manually reset.

13. A document shredder according to claim 12, further characterised in that the manual reset of the load limit value is performed by operating a main switch of the document shredder or by pulling out a mains plug.

14. A document shredder according to claim 1, further characterized in that the motor is a direct current motor with permanent magnets in the stator or a brushless direct current motor or a series machine which is in the form of a universal motor or a direct current motor.

15. A document shredder according to claim 1, further characterized in that the document shredder has a button for manually initiating the reverse mode of the motor and for initiating the increase in the load limit value, wherein the reverse mode can be initiated by operating the button for a brief period, and the increase in the load limit value can be initiated by operating the button for a long period.

16. A document shredder according to claim 1, further characterized in that the motor control switches off the motor when a load limit value which has already been increased is reached.

17. A document shredder according to claim 16, further characterised in that a reverse mode of the motor is initiated when a load limit value which has already been increased is reached.

18. A method for operating a document shredder, in which method a motor for operating a cutting unit of the document shredder can be loaded up to a maximum load limit value, and overloading can be identified on the basis of the load limit value being reached during a shredding operation, characterized in that the load limit value is prespecified by setting a maximum permissible current for operating the motor or by setting a maximum permissible motor torque or by setting a minimum rotation speed of the motor, and in the case of overloading during the shredding operation, the motor is operated in a turbo mode, in which the load limit value is increased, for a predetermined time.

19. A method according to claim 18, further characterized in that the turbo mode is initiated automatically or manually.

20. A method according to claim 18, further characterized in that in the case of overloading, the motor is initially temporarily operated in a reverse mode and then switched off and then the reverse mode of the motor or the turbo mode is initiated.

21. A method according to claim 18, further characterized in that the predetermined time of the turbo mode lasts until the document which is currently to be shredded has been completely shredded.

22. A method according to claim 18 or 21, further characterized in that the load limit value is reduced to its initial value again after the predetermined time.

23. A method according to claim 18, further characterized in that the load limit value prespecifies a maximum permissible torque of the motor, and in the turbo mode, the maximum permissible torque of the motor is increased and/or the minimum permissible rotation speed of the motor is reduced.

* * * * *